US008826834B2

(12) United States Patent
Hartvigsen et al.

(10) Patent No.: US 8,826,834 B2
(45) Date of Patent: Sep. 9, 2014

(54) APPARATUS AND METHOD OF ELECTRIC ARC INCINERATION

(75) Inventors: Joseph J. Hartvigsen, Kaysville, UT (US); Michele Hollist, South Jordan, UT (US); Singaravelu Elangovan, South Jordan, UT (US); Piotr Czernichowski, Layton, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 621 days.

(21) Appl. No.: 11/777,900

(22) Filed: Jul. 13, 2007

(65) Prior Publication Data

US 2009/0056604 A1 Mar. 5, 2009

Related U.S. Application Data

(60) Provisional application No. 60/807,363, filed on Jul. 14, 2006, provisional application No. 60/891,166, filed on Feb. 22, 2007.

(51) Int. Cl.

| | |
|---|---|
| ***F23G 5/10*** | (2006.01) |
| ***H05H 1/48*** | (2006.01) |
| ***F23G 5/02*** | (2006.01) |
| ***F23G 7/00*** | (2006.01) |

(52) U.S. Cl.

CPC ..... *F23G 7/003* (2013.01); *F23G 2209/20* (2013.01); *H05H 1/48* (2013.01); *F23G 5/10* (2013.01); *F23G 2204/201* (2013.01); *F23G 5/02* (2013.01)

USPC ..... 110/250; 110/297

(58) Field of Classification Search

CPC . F23B 2900/00006; F23G 5/085; F23G 5/10; F23G 2204/201

USPC ..... 110/250

See application file for complete search history.

(56) References Cited

U.S. PATENT DOCUMENTS

| | | | | |
|---|---|---|---|---|
| 3,863,107 | A | 1/1975 | Mogensen et al. | |
| 4,144,444 | A | 3/1979 | Dementiev et al. | |
| 4,198,590 | A | 4/1980 | Harris | |
| 4,580,505 | A * | 4/1986 | Golden | 110/302 |

(Continued)

FOREIGN PATENT DOCUMENTS

| | | |
|---|---|---|
| CA | 1059065 | 7/1979 |
| CH | 378296 | 6/1964 |

(Continued)

OTHER PUBLICATIONS

Copenheaver, B. R., International Search Report for PCT/US07/16050 sent Mar. 4, 2008, 1-2.

(Continued)

*Primary Examiner* — Kenneth Rinehart
*Assistant Examiner* — David J Laux
(74) *Attorney, Agent, or Firm* — David Fonda

(57) ABSTRACT

A method and apparatus for incinerating a medical waste material. The method includes introducing a volume of the medical waste material into a plasma zone of a non-thermal plasma generator. The method also includes introducing a volume of oxidizer into the plasma zone of the non-thermal plasma generator. The method also includes generating an electrical discharge between electrodes within the plasma zone of the non-thermal plasma generator to incinerate the medical waste material.

14 Claims, 8 Drawing Sheets

(56) References Cited

U.S. PATENT DOCUMENTS

| | | | | | |
|---|---|---|---|---|---|
| 4,588,850 | A | | 5/1986 | Mueller et al. | |
| 4,606,799 | A | | 8/1986 | Pirklbauer et al. | |
| 4,661,763 | A | | 4/1987 | Ari et al. | |
| 4,861,446 | A | | 8/1989 | Blom et al. | |
| 5,043,636 | A | | 8/1991 | Klopotek et al. | |
| 5,339,754 | A | * | 8/1994 | Lyon | 110/345 |
| 5,376,332 | A | | 12/1994 | Martens et al. | |
| 5,711,859 | A | | 1/1998 | Caramel et al. | |
| 5,993,761 | A | * | 11/1999 | Czernichowski et al. | 423/210 |
| 6,007,742 | A | * | 12/1999 | Czernichowski et al. | 252/372 |
| 6,152,050 | A | * | 11/2000 | Tsantrizos et al. | 110/185 |
| 6,924,608 | B2 | | 8/2005 | Czernichowski et al. | |
| 7,299,756 | B2 | * | 11/2007 | Gnedenko et al. | 110/250 |
| 2005/0269978 | A1 | | 12/2005 | Czernichowski et al. | |
| 2006/0144305 | A1 | * | 7/2006 | Vera | 110/250 |

FOREIGN PATENT DOCUMENTS

| | | |
|---|---|---|
| FR | 2049269 | 3/1971 |
| FR | 2593493 | 7/1987 |
| FR | 2639172 | 5/1990 |
| FR | 2724806 | 3/1996 |
| FR | 2775864 | 9/1999 |
| GB | 2172011 | 9/1986 |
| PL | 172152 | 7/1995 |
| RO | 112225 | 6/1997 |
| WO | WO-9426656 | 11/1994 |
| WO | WO-9506225 | 3/1995 |

OTHER PUBLICATIONS

Copenheaver, B. R., Written Opinion for PCT/US07/16050 sent Mar. 4, 2008, 1-5.

Hartvigsen, et al., U.S. Appl. No. 12/036,170, filed Feb. 22, 2008, 1-31.

Hartvigsen, et al., U.S. Appl. No. 11/777,242, filed Jul. 12, 2007, 1-30.

Lesueur, et al., "Electrically Assisted Partial Oxidation of Methane", *Int. J. Hydrogen Enemy*, vol. 19, No. 2, (1994), 139-144.

Meguernes, et al., "Oxidization of CH4 by H2 in a gliding electric arc", 3rd European Congress on Thermal Plasma Processes, Aachen, Germany, Sep. 19-21, 1994, abstract No. 80; full text in *VDI Berichte* 1166, (1995), 495-500.

Alemu, Office Action for U.S. Appl. No. 09/995,125 sent May 7, 2003, 1-6.

Alemu, Office Action for U.S. Appl. No. 11/186,711 sent Mar. 27, 2007, 1-6.

Alemu, Office Action for U.S. Appl. No. 11/186,711 sent Aug. 8, 2006, 1-6.

Alemu, Office Action for U.S. Appl. No. 11/186,711 sent Feb. 7, 2006, 1-6.

Nave, Office Action for U.S. Appl. No. 09/005,647 sent Jan. 13, 1999, 1-7.

Nave, Office Action for U.S. Appl. No. 09/144,318 sent Mar. 17, 1999, 1-10.

Petit, PCT Written Opinion for PCT/US98/18027 sent Jul. 16, 1999, 1-4.

Bijn, PCT International Search Report for PCT/US01/44307 sent May 17, 2012, 1-5.

Clement, PCT International Search Report for PCT/US98/18027 sent Jan. 4, 1999, 1-5.

Mayekar, K. PCT International Search Report for PCT/US98/00393 sent May 4, 1995, 1-4.

Abstract of FR2724806, DialogWeb Derwent database search results for English-language, printed on Jan. 25, 1999, 1-2.

Czernichowski, et al., Abstract of FR2775864, (Dec. 10, 2007), 1.

Jorgensen, et al., Abstract of FR2593493, (Dec. 10, 2007), 1.

Lesueur, et al., Abstract of FR2639172, (Dec. 10, 2007), 1.

Esp@cenet automated translation of description and claims of FR2049269, (Dec. 10, 2007), 3.

Esp@cenet automatedtranslation of Description and Claims of CH378296, (Dec. 10, 2007), 1-4.

Kanda, Kazuki "Translation of Japanese Office Action", JP App. No. 2009-550921, (Aug. 2, 2011),1-15.

* cited by examiner

APPARATUS AND METHOD OF ELECTRIC ARC INCINERATION

CROSS-REFERENCE TO RELATED APPLICATIONS

This application claims the benefit of U.S. Provisional Application No. 60/807,363, filed on Jul. 14, 2006, which is incorporated by reference herein in its entirety. This application also claims the benefit of U.S. Provisional Application No. 60/891,166, filed on Feb. 22, 2007, which is incorporated by reference herein in its entirety.

BACKGROUND

The use of a safe, complete, and environmentally benign process is useful in the disposal of medical waste materials. Medical waste materials may be in liquid or solid form. Exemplary types of medical waste materials include human tissues and organs removed during a medical treatment process. Other exemplary medical waste materials include biological organisms, either living or dead, which result from activities in a medical laboratory.

The conventional method for disposing of medical waste materials uses incineration technology. In particular, the medical waste materials are placed within a container such as bin, and the container is placed within a natural gas or electric incinerator. The heat of the incinerator burns the medical waste material. However, incineration of medical waste materials can result in harmful gases, offensive odors, and other dangerous conditions. For example, the incinerated waste material may result in harmful, partially combusted gas species. Additionally, the medical waste material tends to coke on the incinerator. These and other issues make incineration of medical waste materials difficult.

SUMMARY

A method and apparatus for incinerating contaminated biological and medical waste material is described. The incineration is achieved by complete oxidation of the biological or medical waste material within a non-thermal plasma generator. The oxidizer may be air, oxygen, steam, or a combination of at least two of air, oxygen, and steam. In one embodiment, the oxidizer is a chemical compound containing oxygen. Using a stoichiometrically excessive amount of oxygen facilitates full oxidation of the waste material. The incineration product resulting from the oxidation of the waste material may be, for example, a gas mixture or a solid.

Embodiments of a method are described. In one embodiment, the method includes introducing a volume of the medical waste material into a plasma zone of a non-thermal plasma generator. The method also includes introducing a volume of oxidizer into the plasma zone of the non-thermal plasma generator. The method also includes generating an electrical discharge between electrodes within the plasma zone of the non-thermal plasma generator to incinerate the medical waste material. Other embodiments of the method are also described.

Embodiments of a system are also described. In one embodiment, the system is a system to incinerate a medical waste material. An embodiment of the system includes a non-thermal plasma generator, an oxidizer channel, a medical waste channel, and a heater. The oxidizer channel is coupled to the non-thermal plasma generator. The oxidizer channel is configured to direct an oxidizer into a plasma zone of the non-thermal plasma generator. The medical waste channel is also coupled to the non-thermal plasma generator. The medical waste channel is configured to direct the medical waste material into the plasma zone of the non-thermal plasma generator. The heater is coupled to the medical waste channel to preheat the medical waste material prior to at least partial incineration in the plasma zone of the non-thermal plasma generator.

Another embodiment of the system includes a non-thermal plasma generator, an oxidizer channel, a medical waste channel, and a heat source. The oxidizer channel is coupled to the non-thermal plasma generator to direct an oxidizer into a plasma zone of the non-thermal plasma generator. The medical waste channel is coupled to the non-thermal plasma generator to direct the medical waste material into the plasma zone of the non-thermal plasma generator. The heat source is coupled to the non-thermal plasma generator to heat the plasma zone of the non-thermal plasma generator to an operating temperature to at least partially incinerate the medical waste material. Other embodiments of the system are also described.

Embodiments of an apparatus are also described. In one embodiment, the apparatus is an incineration apparatus. An embodiment of the incineration apparatus includes means for preheating a medical waste material, means for introducing the preheated medical waste material into a plasma zone of a non-thermal plasma generator, means for introducing an oxidizer into the plasma zone of the non-thermal plasma generator, and means for at least partially incinerating the medical waste material within the plasma zone of the non-thermal plasma generator. Other embodiments of the apparatus are also described.

Other aspects and advantages of embodiments of the present invention will become apparent from the following detailed description, taken in conjunction with the accompanying drawings, which are illustrated by way of example of the various principles and embodiments of the invention.

BRIEF DESCRIPTION OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Figure 1A:
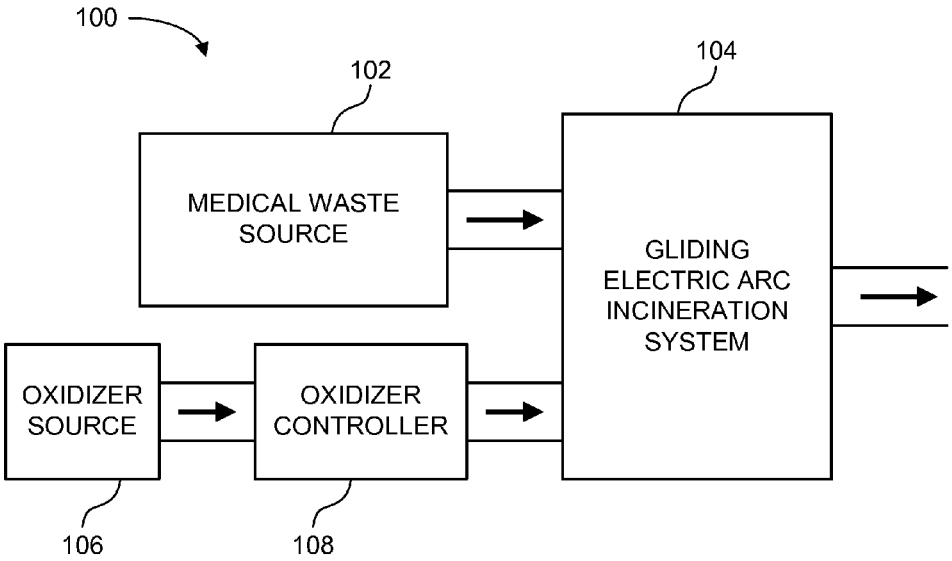
FIG. 1A illustrates a schematic block diagram of one embodiment of an incineration system for incinerating a medical waste material.

FIG. 1A illustrates a schematic block diagram of one embodiment of an incineration system 100 for incineration a medical waste material. The illustrated oxidation system includes a medical waste source 102, a gliding electric arc incineration system 104, an oxidizer source 106, and an oxidizer controller 108. Although certain functionality is described herein with respect to each of the illustrated components of the incineration system 100, other embodiments of the incineration system 100 may implement similar functionality using fewer or more components. Additionally, some embodiments of the incineration system 100 may implement more or less functionality than is described herein.

In one embodiment, the medical waste source 102 supplies a biological or medical waste material to the gliding arc electric incineration system 104. The biological or medical waste material may be, for example, in liquid or solid form. However, the content and composition of the waste material that may be incinerated using the incineration system 100 is not limited. In one embodiment, the waste material is human tissues and organs removed during a medical treatment process. In another embodiment, the waste material is a living or dead biological material resulting from medical research activities. Additionally, in some embodiments, the biological or medical waste material may be introduced to the gliding electric arc incineration system 104 using a carrier material. For example, the biological or medical waste material may be entrained with a liquid or a gas, and the combination of the waste material and the carrier material is introduced into the gliding electric arc incineration system 104.

In one embodiment, the gliding electric arc incineration system 104 is a high energy plasma arc system. Additionally, some embodiments of the gliding electric arc incineration system 104 are referred to as non-thermal plasma generators or systems because the process employed by the gliding electric arc incineration system 104 does not provide a substantial heat input (e.g., compared to conventional incineration systems) for the incineration reaction. It should also be noted that, although the illustrated incineration system 100 includes a gliding electric arc incineration system 104, other embodiments of the incineration system 100 may include other types of non-thermal plasma generators such as a dielectric barrier discharge (DBD), a corona discharge, a pulsed corona discharge, and the like.

In order to facilitate the incineration process implemented by the gliding electric arc incineration system 104, the oxidizer source 106 supplies an oxidizer, or oxidant, to the gliding electric arc incineration system 104. In one embodiment, the oxidizer controller 108 controls the amount of oxidizer such as oxygen that is supplied to gliding electric arc incineration system 104. For example, the oxidizer controller 108 may control the flow rate of the oxidizer from the oxidizer source 106 to the gliding electric arc incineration system 104. The oxidizer may be air, oxygen, steam ($H_2O$), or another type of oxidizer. In some embodiments, oxygen may be used instead of air in order to lower the overall volume of oxidized gas. Embodiments of the oxidizer controller 108 include a manually controlled valve, an electronically controlled valve, a pressure regulator, an orifice of specified dimensions, or another type of flow controller. Another embodiment of the oxidizer controller 108 incorporates an oxidant composition sensor feedback system.

In one embodiment, the oxidizer mixes with the waste material within the gliding electric arc incineration system 104. Alternatively, the waste material and the oxidizer may be premixed before the mixture is injected into the gliding electric arc incineration system 104. Additionally, the oxidizer, the waste material, or a mixture of the oxidizer and the waste material may be preheated prior to injection into the gliding electric arc incineration system 104.

In general, the gliding electric arc incineration system 104 oxidizes the waste material and outputs an incineration product that is free or substantially free of harmful materials. More specific details of the incineration process are described below with reference to the following figures. It should be noted that the incineration process depends, at least in part, on the amount of oxidizer that is combined with the waste material and the temperature of the reaction. In some instances, it may be beneficial to input heat into the gliding electric arc incineration system 104 to increase the effectiveness of the incineration process.

In one embodiment, full oxidation (referred to simply as oxidation) of the waste material produces an incineration product. Full oxidation occurs when the amount of oxygen used in the incineration reaction is more than a stoichiometric amount of oxygen. In some embodiments, 5-100% excess of stoichiometric oxygen levels are used to implement full oxidation within the incineration process. An exemplary oxidation equation is:

$$(\text{—}CH_n\text{—}) + \left(1 + \frac{n}{4}\right)O_2 \rightarrow CO_2 + \frac{n}{2}H_2O$$

Other equations may be used to describe other types of reformation and oxidation processes. Another exemplary oxidation equation utilizes $C_nH_mO_k$ such as:

$$C_6H_{12}O_5(\text{Cellulose}) + 6O_2 \rightarrow 6CO_2 + 5H_2O$$

The incineration process implemented using the gliding electric arc incineration system 104 may be endothermic or exothermic. In some instances, given the composition of biological and medical waste material, heat may be input into the gliding electric arc system 104 to facilitate incineration. For example, it may be useful to maintain part or all of the gliding electric arc incineration system 104 at an operating temperature within an operating temperature range for efficient operation of the gliding electric arc incineration system 104. In one embodiment, the gliding electric arc incineration system 104 is mounted within a furnace (refer to FIGS. 9A and 9B) during operation to maintain the operating temperature of the gliding electric arc incineration system 100 within an operating temperature range of approximately 700° C. to 1200° C. Other embodiments may use other operating temperature ranges.

Alternatively, or in addition to generally heating the gliding electrical arc incineration system 104, some embodiments of the incineration system 100 may preheat the medical waste material from the medical waste source 102, the oxidizer from the oxidizer source 106, or both. The waste material and/or the oxidizer may be preheated individually at the respective sources or at some point prior to entering the gliding electric arc incineration system 104. For example, the waste material may be preheated within the medical waste channel which couples the medical waste source 102 to the gliding electric arc incineration system 104. Alternatively, the waste material and/or the oxidizer may be preheated individually within the gliding electric arc incineration system 104. In another embodiment, the waste material and the oxidizer may be mixed and preheated together as a mixture before or after entering the gliding electric arc incineration system 104.

Figure 1B:
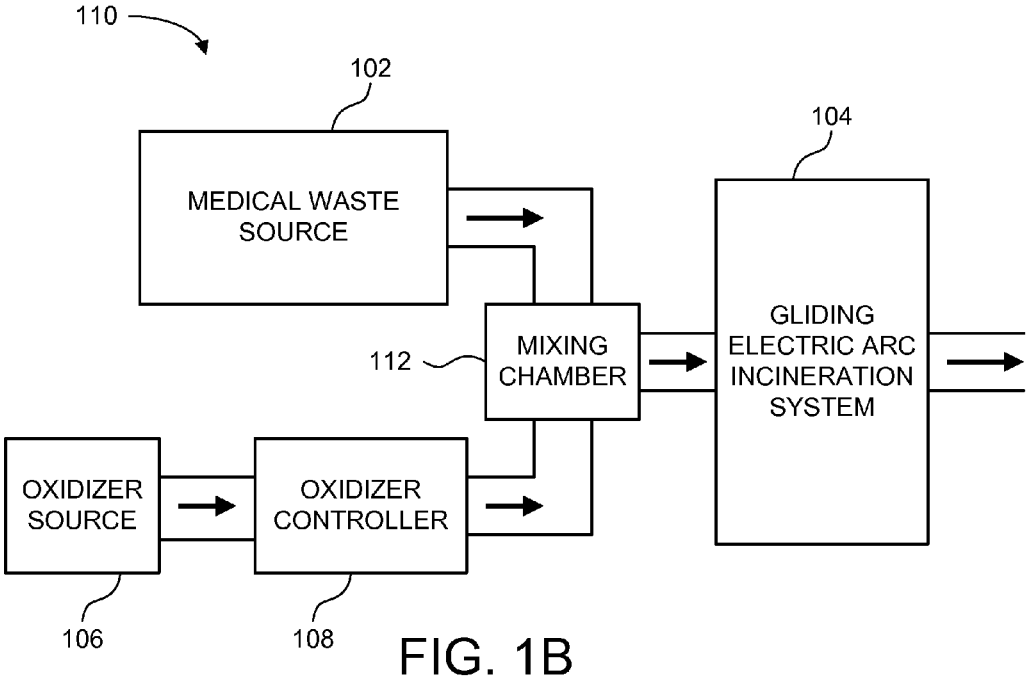
FIG. 1B illustrates a schematic block diagram of another embodiment of an incineration system for incinerating a medical waste material.

FIG. 1B illustrates a schematic block diagram of another embodiment of an incineration system 110 for incinerating a medical waste material. Although certain functionality is described herein with respect to each of the illustrated components of the incineration system 110, other embodiments of the incineration system 110 may implement similar functionality using fewer or more components. Additionally, some embodiments of the incineration system 110 may implement more or less functionality than is described herein.

The illustrated incineration system 110 shown in FIG. 1B is substantially similar to the incineration system 100 shown in FIG. 1A, except that the incineration system 110 shown in FIG. 1B also includes a mixing chamber 112. The mixing chamber 112 is coupled between the medical waste source 102 and the gliding electric arc incineration system 104. The mixing chamber 112 is also coupled to the oxidizer source 106, for example, via the oxidizer controller 108. In one embodiment, the mixing chamber 112 facilitates premixing the waste material and the oxidizer prior to introduction into the gliding electric arc incineration system 104. In some embodiments, the mixing chamber 112 may be a separate chamber coupled to conduits connected to the medical waste source 102, the gliding electric arc incineration system 104, and the oxidizer controller 108. In other embodiments, the mixing chamber 112 may be a shared channel, or conduit, to jointly transfer the waste material and the oxidizer to the gliding electric arc incineration system 104.

Figure 2:
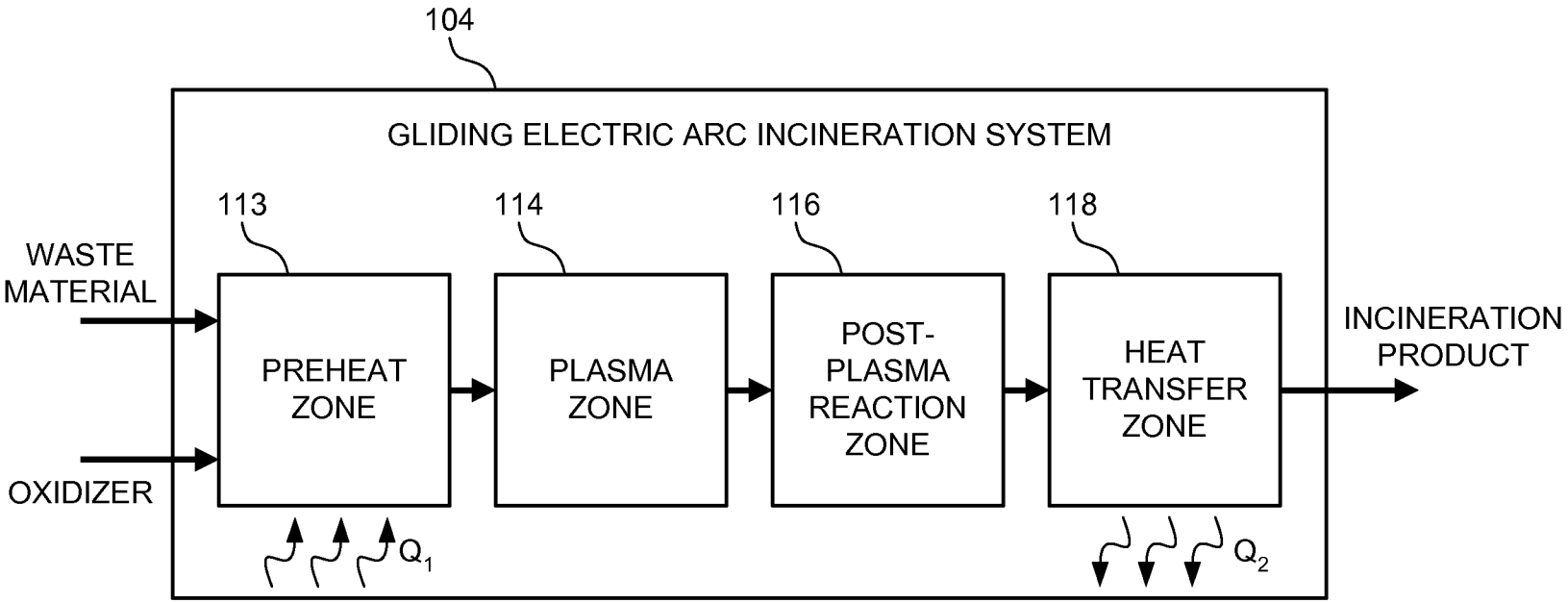
FIG. 2 illustrates a schematic block diagram of one embodiment of the gliding electric arc incineration system of the incineration system of FIG. 1A.

FIG. 2 illustrates a schematic block diagram of one embodiment of the gliding electric arc incineration system 104 of the incineration system 100 of FIG. 1A. The illustrated gliding electric arc incineration system 104 includes a preheat zone 113, a plasma zone 114, a post-plasma reaction zone 116, and a heat transfer zone 118. Although four separate functional zones are described, some embodiments may implement the functionality of two or more zones at approximately the same time and/or in approximately the same physical proximity. For example, heat transfer corresponding to the illustrated heat transfer zone 118 may occur during plasma generation corresponding to the plasma zone 114. Similarly, heat transfer corresponding to the heat transfer zone 118 may occur in approximately the same location as post-plasma reactions corresponding to the post-plasma reaction zone 116.

In one embodiment, the waste material and the oxidizer are introduced into the preheat zone 113. Within the preheat zone 113, the waste material and the oxidizer are preheated (represented by the heat transfer $Q_1$) individually or together. In an alternative embodiment, one or both of the waste material and the oxidizer may bypass the preheat zone 113. The waste material and the oxidizer then pass to the plasma zone 114 from the preheat zone 113 (or pass directly to the plasma zone from the respective sources, bypassing the preheat zone 113). Within the plasma zone, the waste material is at least partially incinerated by a non-thermal plasma generator (refer to FIGS. 3A-C) such as a gliding electric arc. The non-thermal plasma generator acts as a catalyst to initiate the oxidation process to incinerate the waste material. More specifically, the non-thermal plasma generator ionizes, or breaks apart, one or more of the reactants to create reactive elements.

After ionization, the reactants pass to the post-plasma reaction zone 116, which facilitates homogenization of the oxidized composition. Within the post-plasma reaction zone 116, some of the reactants and the products of the reactants are oxygen rich while others are oxygen lean. A homogenization material such as a solid state oxygen storage compound within the post-plasma reaction zone 116 acts as a chemical buffering compound to physically mix, or homogenize, the oxidation reactants and products. Hence, the oxygen storage compound absorbs oxygen from oxygen-rich packets and releases oxygen to oxygen-lean packets. This provides both spatial and temporal mixing of the reactants to help the reaction continue to completion. In some embodiments, the post-plasma reaction zone 116 also facilitates equilibration of gas species and transfer of heat.

The heat transfer zone 118 also facilitates heat transfer (represented by the heat transfer $Q_2$) from the incineration product to the surrounding environment. In some embodiments, the heat transfer zone 118 is implemented with passive heat transfer components which transfer heat, for example, from the oxidation product to the homogenization material and to the physical components (e.g., housing) of the gliding electrical arc incineration system 104. Other embodiments use active heat transfer components to implement the heat transfer zone 118. For example, forced air over the exterior surface of a housing of the gliding electric arc oxidation system 104 may facilitate heat transfer from the housing to the nearby air currents. As another example, an active stream of a cooling medium may be used to quench an oxidation product. In another embodiment, the gliding electric arc incineration system 104 may be configured to facilitate heat transfer from the heat transfer zone 118 to the preheat zone 113 to preheat the waste material and/or the oxidizer.

Figure 3A:
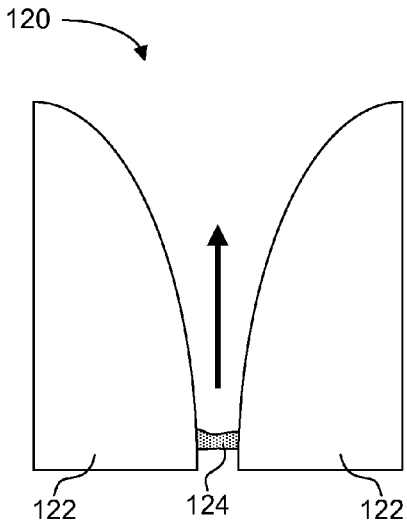
FIGS. 3A-C illustrate schematic diagrams of a non-thermal plasma generator of the gliding electric arc incineration system of FIG. 2.
Figure 3B:
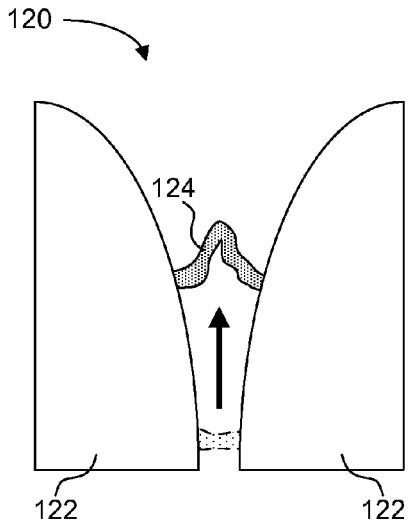
Figure 3C:
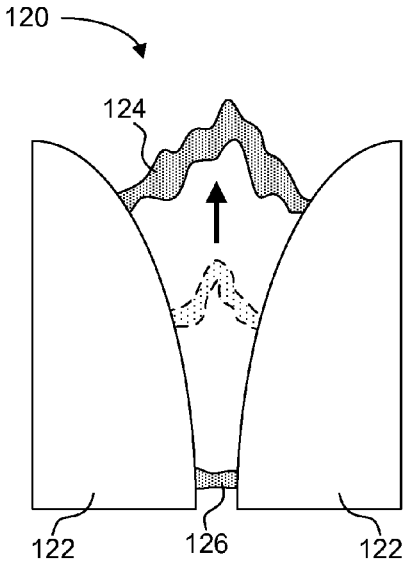

FIGS. 3A-C illustrate schematic diagrams of a non-thermal plasma generator 120 of the gliding electric arc incineration system 104 of FIG. 2. The depicted non-thermal plasma generator 120 includes a pair of electrodes 122. However, other embodiments may include more than two electrodes 122. For example, some embodiments of the plasma generator 120 include three electrodes 122. Other embodiments of the plasma generator 120 include six electrodes 122 or another number of electrodes 122. Each electrode 122 is coupled to an electrical conductor (not shown) to provide an electrical signal to the corresponding electrode 122. Where multiple electrodes 122 are implemented, some electrodes 122 may be coupled to the same electrical conductor so that they are on the same phase of a single-phase or a multi-phase electrical distribution system.

The electrical signals on the electrodes 122 produce a high electrical field gradient between each pair of electrodes 122. For example, if there is a separation of 2 millimeters between a pair of electrodes 122, the electrical potential between the electrodes 122 of about 6-9 kV can create an electrical arc to initiate formation of plasma.

The mixture of the waste material and the oxidizer enters and flows axially through the plasma generator 120 (in the direction indicated by the arrow). The high voltage between the electrodes 122 ionizes the mixture of reactants, which allows current to flow between the electrodes 122 in the form of an arc 124, as shown in FIG. 3A. Because the ions of the reactants are in an electric field having a high potential gradient, the ions begin to accelerate toward one of the electrodes 122. This movement of the ions causes collisions which create free radicals. The free radicals initiate a chain reaction for incineration of the waste material.

Due to the flow of the mixture into the plasma generator 120, the ionized particles are forced downstream, as shown in FIG. 3B. Since the ionized particles form the least resistive path for the current to flow, the arc 124 also moves downstream (as indicated by the arrow) and spreads out to follow the contour of the diverging edges of the electrodes 122. Although the edges of the electrodes 122 are shown as elliptical contours, other variations of diverging contours may be implemented. As the arc 124 moves downstream, the effect of the reaction is magnified relative to the size of the arc 124.

Eventually, the gap between the electrodes 122 becomes wide enough that the current ceases to flow between the electrodes 122. However, the ionized particles continue to move downstream under the influence of the mixture. Once the current stops flowing between the electrodes 122, the electrical potential increases on the electrodes 122 until the current arcs again, as shown in FIG. 3C, and the plasma generation process continues. Although much of the oxidation process may occur at the plasma generator 120 between the electrodes 122, the oxidation process may continue downstream from the plasma generator 120.

Figure 4:
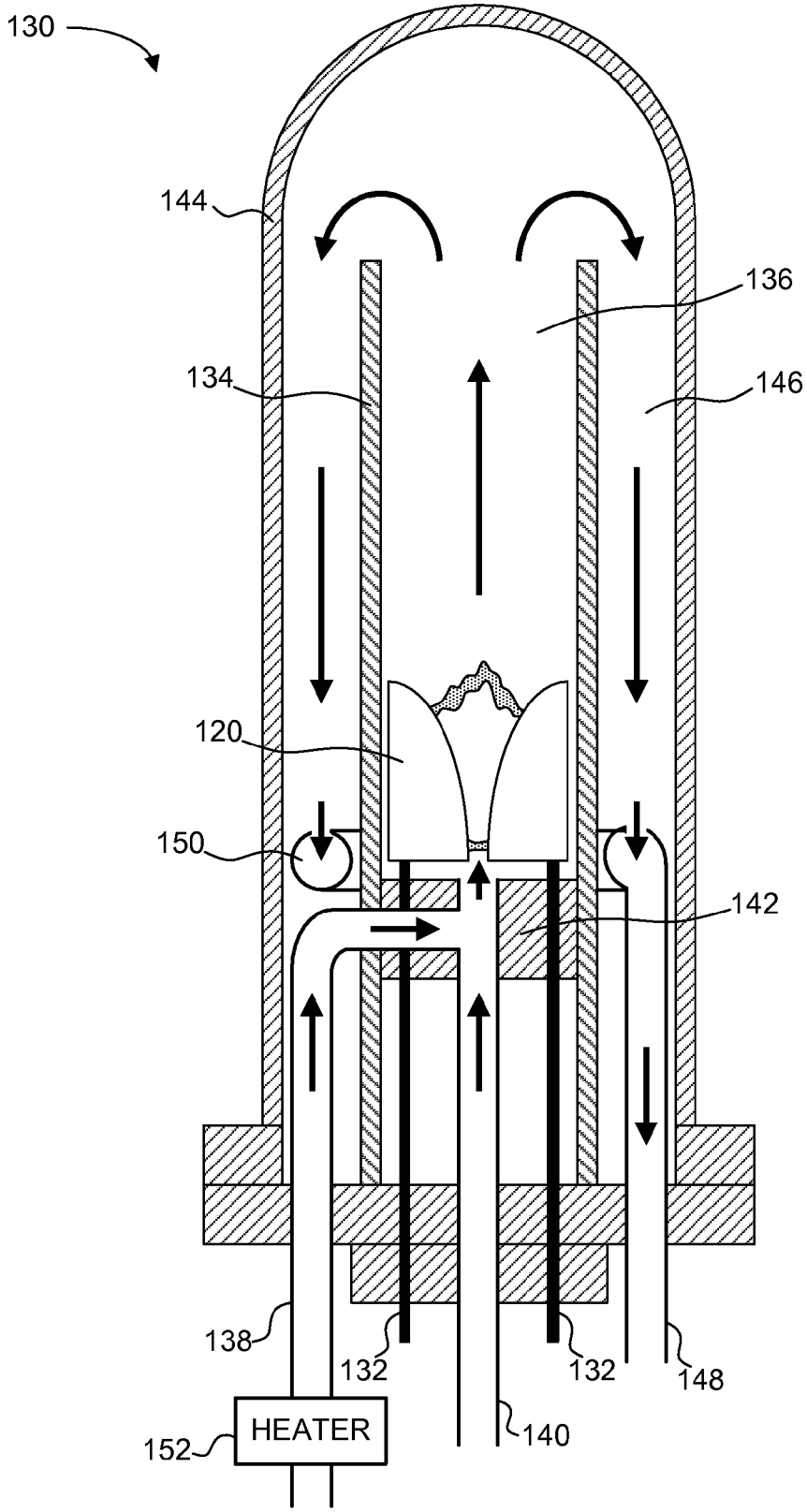
FIG. 4 illustrates a schematic diagram of another embodiment of the gliding electric arc incineration system.

FIG. 4 illustrates a schematic diagram of another embodiment of the gliding electric arc incineration system 130. The illustrated gliding electric arc incineration system 130 includes a plasma generator 120. Each of the electrodes 122 of the plasma generator 120 is connected to an electrical conductor 132. The plasma generator 120 is located within a housing 134. In one embodiment, the housing 134 defines a channel 136 downstream of the plasma generator 120 so that the reactants may continue to react and form the oxidation product downstream of the plasma generator 120. The housing 134 may be fabricated of a conductive or non-conductive material. In either case, an electrically insulated region may be provided around the plasma generator 120. In one embodiment, the housing 134 is fabricated from a non-conductive material such as an alumina ceramic to prevent electricity from discharging from the plasma generator 120 to surrounding conductive components.

In order to introduce the waste material and the oxidizer into the plasma generator 120, the gliding electric arc incineration system 130 includes multiple channels, or conduits. In the illustrated embodiment, the gliding electric arc incineration system 130 includes a first channel 138 for the waste material and a second channel 140 for the oxidizer. The first channel is also referred to as the medical waste channel, and the second channel is also referred to as the oxidizer channel. The medical waste and oxidizer channels 138 and 140 join at a mixing manifold 142, which facilitates premixing of the waste material and the oxidizer. In other embodiments, the waste material and the oxidizer may be introduced separately into the plasma generator 120. Additionally, the locations of the medical waste and oxidizer channels 138 and 140 may be arranged in a different configuration.

In order to contain the reactants during the incineration process, and to contain the incineration product resulting from the incineration process, the plasma generator 120 and the housing 134 may be placed within an outer shell 144. In one embodiment, the outer shell 144 facilitates heat transfer to and/or from the gliding electric arc incineration system 130. Additionally, the outer shell 144 is fabricated from steel or another material having sufficient strength and stability at the operating temperatures of the gliding electric arc incineration system 130.

In order to remove the incineration product (e.g., including any carbon dioxide, steam, etc.) from the annular region 146 of the outer shell 144, the gliding electric arc incineration system 130 includes an exhaust channel 148. In one embodiment, the exhaust channel is coupled to a collector ring manifold 150 that circumscribes the housing 134 and has one or more openings to allow the incineration product to flow to the exhaust channel 148. In the illustrated embodiment, the incineration product is exhausted out the exhaust channel 148 at approximately the same end as the intake channels 138 and 140 for the waste material and the oxidizer. This configuration may facilitate easy maintenance of the gliding electric arc incineration system 130 since all of the inlet, outlet, and electrical connections are in about the same place. Other embodiments of the gliding electric arc incineration system 130 may have alternative configurations to exhaust the incineration products from the outer shell 144.

The illustrated gliding electric arc incineration system 130 also includes a heater 152 coupled to the medical waste channel 138. In one embodiment, the heater 152 preheats the medical waste material within the medical waste channel 138 before the medical waste material enters the plasma zone of the gliding electric arc incineration system 130. Depending on the organic and inorganic content of the medical waste, it may be preheated from slightly above ambient to higher temperatures. In one embodiment, the medical waste is preheated to a range of between 50° C. to 400° C.

Figure 5:
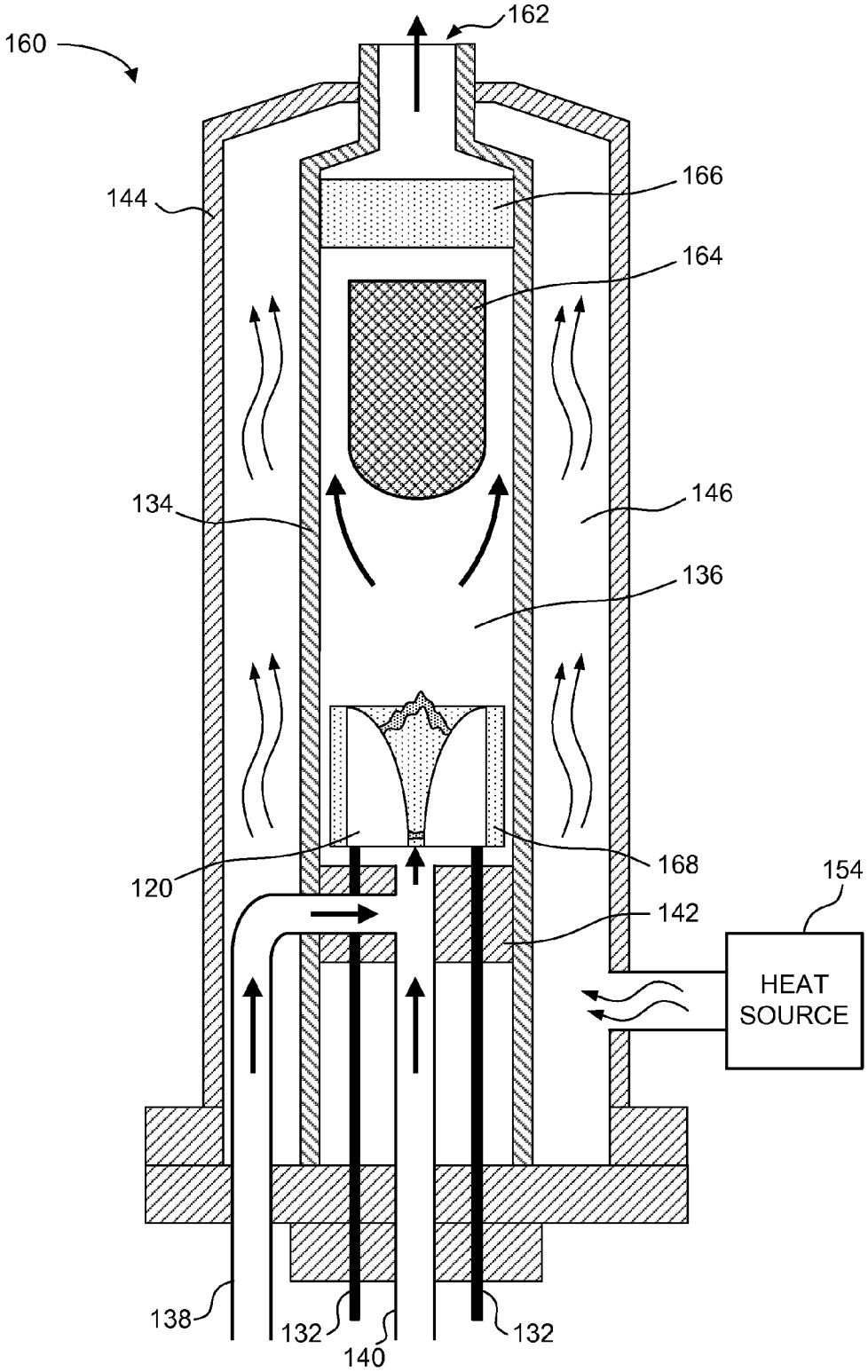
FIG. 5 illustrates a schematic diagram of another embodiment of the gliding electric arc incineration system.

FIG. 5 illustrates a schematic diagram of another embodiment of the gliding electric arc incineration system 160. Although many aspects of the gliding electric arc incineration system 160 of FIG. 5 are substantially similar to the gliding electric arc incineration system 130 of FIG. 4, the gliding electric arc incineration system 160 is different in that it allows pass-through exhaustion of the incineration product through an exhaust outlet 162 at approximately the opposite end of the gliding electric arc incineration system 160 from the intake channels 138 and 140 for the waste material and the oxidizer. In one embodiment, the incineration product passes directly through the channel 136 of the housing 134 and out through the exhaust outlet 162, instead of passing into the annular region 146 of the outer shell 144.

The illustrated gliding electric arc incineration system 160 of FIG. 5 also includes some additional distinctions from the gliding electric arc incineration system 130 of FIG. 4. In particular, the gliding electric arc incineration system 160 includes a diversion plug 164 located within the housing 134 to divert the reactants and incineration product outward toward the interior surface of a wall of the housing 134. For an incineration process that is exothermic, the diversion plug 164 forces the flow toward the wall of the housing 134 to facilitate heat transfer from the incineration product to the wall of the housing 134. In one embodiment, the diversion plug 164 is fabricated from a ceramic material or another material that is stable at high temperatures.

In another embodiment, the gliding electric arc incineration system 160 facilitates heat transfer to the plasma zone, for example, to facilitate an endothermic incineration process. The illustrated gliding electric arc incineration system 160 includes a heat source 154 coupled to the outer shell 144. The heat source 154 supplies a heating agent in thermal proximity to the outer wall of the housing 134 (e.g., within the annular region 146 of the outer shell 144) to transfer heat from the heating agent to the plasma zone of the gliding electric arc incineration system 160. The heating agent may be a gas or a liquid. For example, the heating agent may be air. Although not shown in detail, the heating agent may be circulated within or exhausted from the outer shell 144.

In one embodiment, the gliding electric arc incineration system 160 is initially heated by introducing a mixture of a gaseous hydrocarbon and air. Exemplary gaseous hydrocarbons include natural gas, liquefied petroleum gas (LPG), propane, methane, and butane. Once the temperature of the gliding electric arc oxidation system 160 reaches an operating temperature of about 800° C., the flow of the gaseous hydrocarbon is turned off and waste material is introduced. The flow rates of oxidizer and waste material are adjusted to maintain a proper stoichiometric ratio, while the total flow is adjusted to maintain the plasma generator 120 at a particular operating temperature or within an operating temperature range.

The illustrated gliding electric arc oxidation system 160 also includes a homogenization material 166 located in the channel 136 of the housing 134. The homogenization material 166 serves one or more of a variety of functions. In some embodiments, the homogenization material 166 facilitates homogenization of the incineration product by transferring oxygen from the oxidizer to the waste material. In some embodiments, the homogenization material 166 also provides both spatial and temporal mixing of the reactants to help the reaction continue to completion. In some embodiments, the homogenization material 166 also facilitates equilibration of gas species. In some embodiments, the homogenization material 166 also facilitates heat transfer, for example, from the incineration product to the homogenization material 166 and from the homogenization material 166 to the housing 134. In some embodiments, the homogenization material 166 may provide additional functionality.

The illustrated gliding electric arc incineration system 160 also includes a ceramic insulator 168 to electrically insulate the electrodes 122 from the housing 134. Alternatively, the gliding electric arc incineration system 160 may include an air gap between the electrodes 122 and the housing 134. While the dimensions of the air gap may vary in different implementations depending on the operating electrical properties and the fabrication materials used, the air gap should be sufficient to provide electrical isolation between the electrodes 122 and the housing 134 so that electrical current does not arc from the electrodes 122 to the housing 134.

Figure 6A:
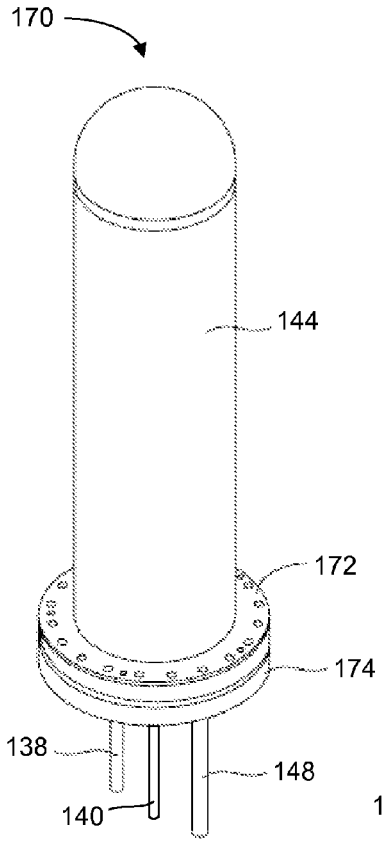
FIGS. 6A-C illustrate schematic diagrams of another embodiment of the gliding electric arc incineration system.
Figure 6B:
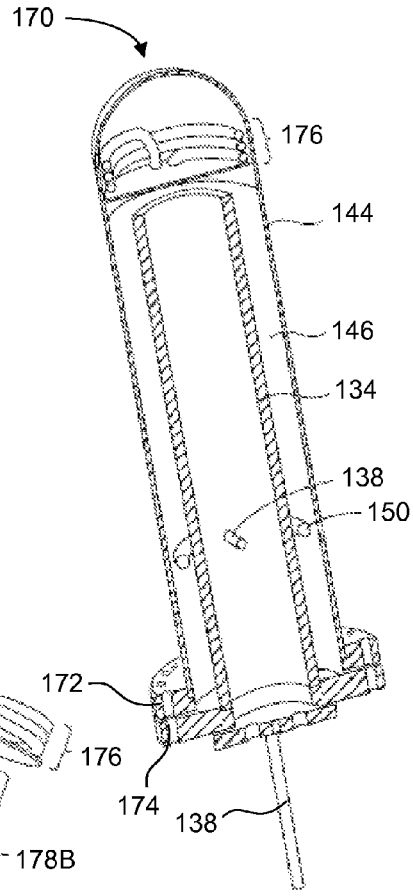
Figure 6C:
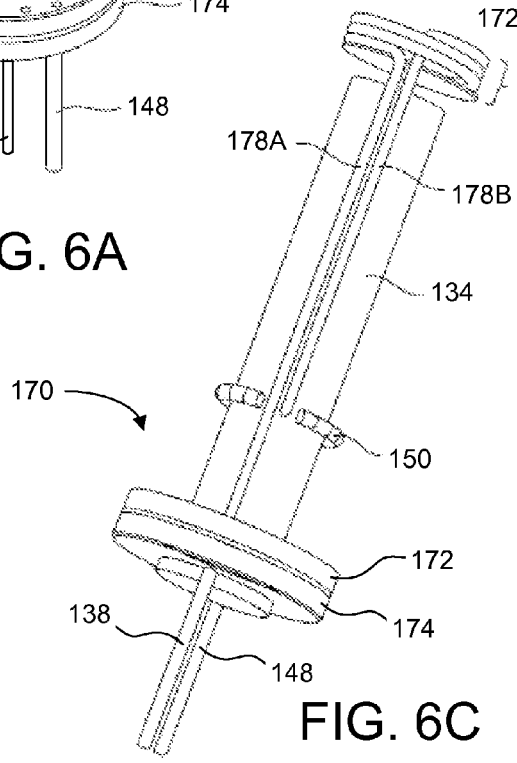

FIGS. 6A-C illustrate schematic diagrams of various perspective views of another embodiment of the gliding electric arc incineration system 170. In particular, FIG. 6A illustrates the outer shell 144 having a flange 172 mountable to a furnace or other surface. A second flange 174 may be attached to at least some of the internal components described above, allowing the internal components to be removed from the outer shell 144 without removing or detaching the outer shell 144 from a mounted position. The channels 138 and 140 for the waste material and the oxidizer and the exhaust channel 148 are also indicated.

FIG. 6B shows a cutaway view of the outer shell 144, the housing 134, the waste channel 138 (the channels 140 and 148 are not shown), the collector ring manifold 150, and the flanges 172 and 174. The illustrated embodiment also includes an oxidizer coil 176 which is coupled to the oxidizer channel 140. The oxidizer coil 176 is part of a preheat channel portion which extends into the flow path of the incineration product. In this way, heat may transfer from the incineration product to the oxidizer within the oxidizer coil 176 to preheat the oxidizer. In other words, the oxidizer coil 176 receives heat from the incineration process in order to preheat the oxidizer before it is mixed with the waste material. In an alternative embodiment, a similar coil or other structure may be used to preheat the waste material or a combination of the waste material and the oxidizer. FIG. 6C also shows the housing 134, the channels 138 and 148 (the channel 140 is not shown), the collector ring manifold 150, the flanges 172 and 174, and the oxidizer coil 176. The illustrated embodiment also includes a first channel extension 178A to couple the oxidizer channel 140 to the oxidizer coil 176 and a second channel extension 178B to deliver the preheated oxidizer from the oxidizer coil 176 to the plasma zone of the gliding electric arc incineration system 170.

Figure 7A:
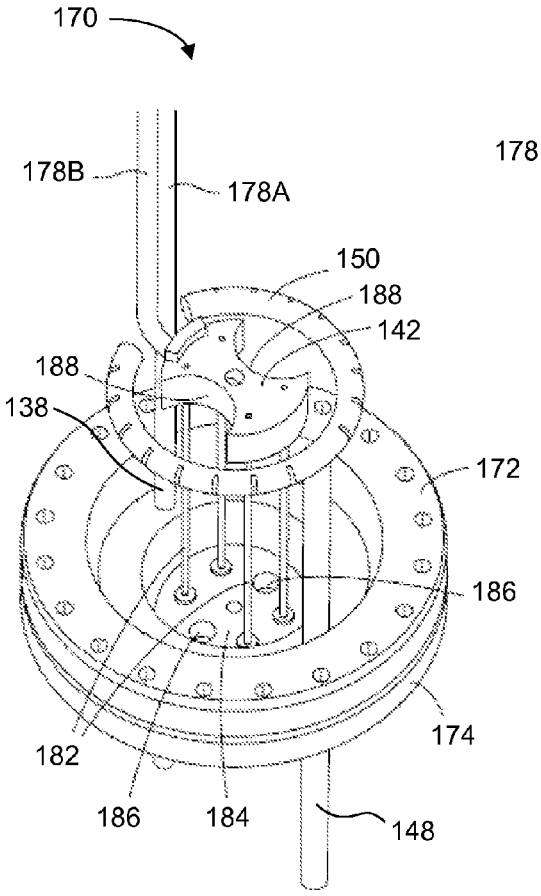
FIGS. 7A and 7B illustrate schematic diagrams of additional perspective views of the gliding electric arc incineration system of FIGS. 6A-C.
Figure 7B:
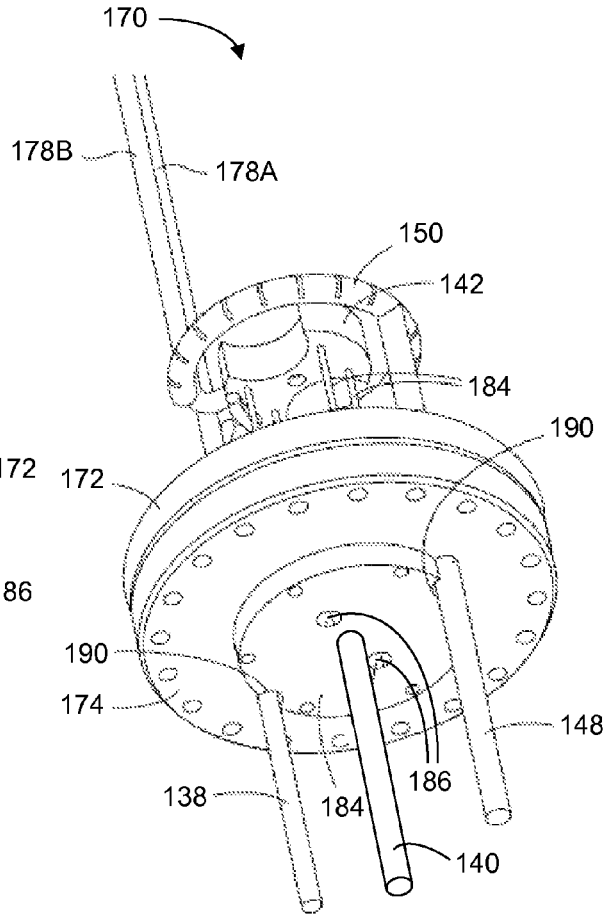

FIGS. 7A and 7B illustrate schematic diagrams of additional perspective views of the gliding electric arc incineration system 170 of FIGS. 6A-C. In particular, FIGS. 7A and 7B illustrate embodiments of the waste and oxidizer channels 138 and 140, the exhaust channel 148, the mixing manifold 142, the collector ring manifold 150, and the flanges 172 and 174. The channel extensions 178A and 178B are also shown. Additionally, the gliding electric arc incineration system 130 includes several support bars 182 connected to a bottom mounting plate 184 to support the mixing manifold 142. In one embodiment, the bottom mounting plate 184 includes apertures 186 to accommodate the electrical conductors 132. In some embodiments, the electrical conductors 132 also provide structural support for the electrodes 122 to which they are connected. For example, the electrical conductors 132 may pass through cutout regions 188 defined by the mixing manifold 142, without touching the mixing manifold 142, to support the electrodes 122 at a distance from the mixing manifold 142. In one embodiment, the conductors 312 are surrounded by electrical insulators at the apertures 186 to prevent electricity from discharging to the bottom mounting plate 184.

In some embodiments, the bottom mounting plate 184 may be removed from the flanges 172 and 174 to remove the mixing manifold 142 and the electrodes 122 from the housing 134 and the outer shell 144. Additionally, in some embodiments, one or more notches 190 are formed in the bottom mounting plate 184 to facilitate proper alignment of the mixing manifold 142 with the channels 138 and 140.

Figure 8A:
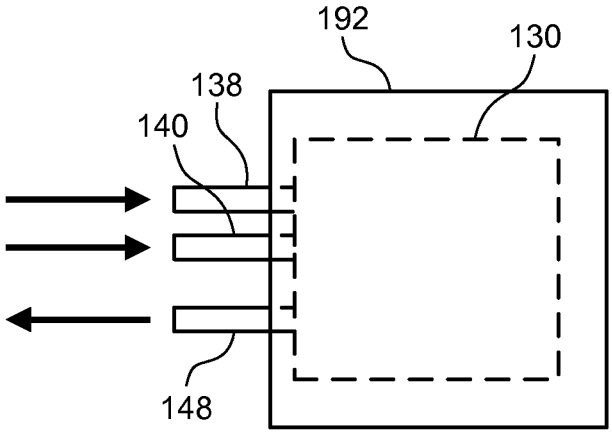
FIG. 8A illustrates a schematic block diagram of an embodiment of the gliding electric arc incineration system of FIG. 4 within a furnace.
Figure 8B:
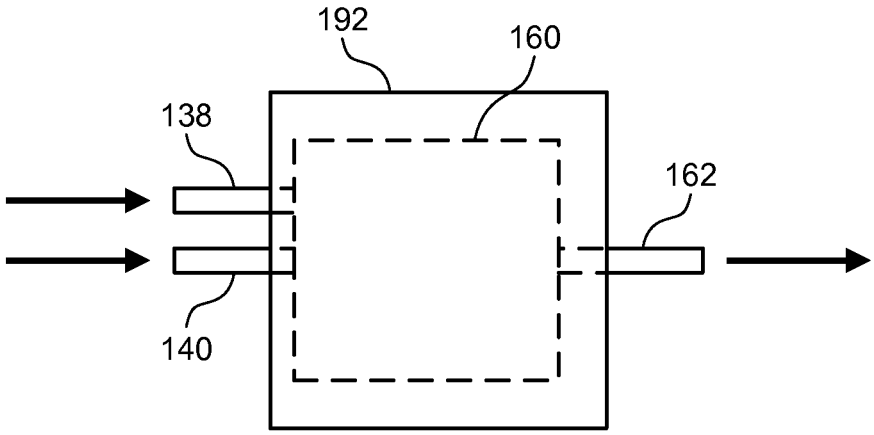
FIG. 8B illustrates a schematic block diagram of an embodiment of the gliding electric arc incineration system of FIG. 5 within a furnace.

FIG. 8A illustrates a schematic block diagram of an embodiment of the gliding electric arc incineration system 130 of FIG. 4 within a furnace 192. Similarly, FIG. 8B illustrates a schematic block diagram of an embodiment of the gliding electric arc incineration system 160 of FIG. 5 within a furnace 192. As explained above, it may be useful to mount embodiments of the gliding electric arc incineration systems 130, 160, and 170 inside a furnace 192 to maintain the gliding electric arc incineration systems 130, 160, and 170 at a temperature within a particular operating temperature.

Reference throughout this specification to "one embodiment," "an embodiment," or similar language means that the described feature, operation, structure, or characteristic may be implemented in at least one embodiment. Thus, the phrases "in one embodiment," "in an embodiment," and similar phrases throughout this specification may, but do not necessarily, refer to the same embodiment.

Furthermore, the described features, operations, structures, or characteristics of the described embodiments may be combined in any suitable manner. Hence, the numerous details provided here, such as examples of electrode configurations, housing configurations, substrate configurations, channel configurations, catalyst configurations, and so forth, provide an understanding of several embodiments of the invention. However, some embodiments may be practiced without one or more of the specific details, or with other features operations, components, materials, and so forth. In other instances, well-known structures, materials, or operations are not shown or described in at least some of the figures for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A method for incinerating a medical waste material, the method comprising:

introducing a volume of the medical waste material into a plasma zone of a non-thermal plasma generator, the plasma zone surrounded by a housing;

introducing a volume of oxidizer into the plasma zone of the non-thermal plasma generator to fully oxidize the medical waste material;

generating an electrical discharge between electrodes within the plasma zone of the non-thermal plasma generator to incinerate the medical waste material, thereby generating an incineration product;

conveying the incineration product to a post-plasma reaction zone within the housing; and during incineration, supplying a heating agent to an outer wall of the housing to enable heat transfer into the plasma and post-plasma reaction zones to facilitate more complete incineration of the medical waste material, wherein the heating agent does not enter the plasma or post-plasma reaction zones.

2. The method of claim 1, wherein the non-thermal plasma generator comprises a gliding electric arc incineration system.

3. The method of claim 1, further comprising preheating the oxidizer prior to incineration of the medical waste material.

4. The method of claim 3, wherein preheating the oxidizer further comprises transferring heat resulting from a reaction within the non-thermal plasma generator to the oxidizer.

5. The method of claim 1, further comprising preheating the medical waste material prior to incineration of the medical waste material.

6. The method of claim 5, wherein preheating the medical waste material comprises transferring heat from a heat source to the medical waste material within a medical waste channel.

7. The method of claim 1, further comprising heating the non-thermal plasma generator to an operating temperature within an operating temperature range.

8. The method of claim 7, wherein heating the non-thermal plasma generator to the operating temperature further comprises heating the non-thermal plasma generator within a furnace.

9. The method of claim 7, wherein heating the non-thermal plasma generator to the operating temperature further comprises flowing a heating agent over the outer wall of the housing to transfer heat from the heating agent to the outer wall.

10. The method of claim 1, wherein the oxidizer comprises a composition of at least one of air, oxygen, and steam.

11. The method of claim 1, further comprising creating a mixture of the medical waste material and a carrier material, wherein introducing the volume of the medical waste material into the plasma zone of the non-thermal plasma generator comprises introducing the mixture of the medical waste material and the carrier material into the plasma zone of the non-thermal plasma generator.

12. The method of claim 1, further comprising:

premixing a mixture of the volume of medical waste material and the volume of oxidizer outside of the plasma zone of the non-thermal plasma generator; and introducing the mixture of the volume of medical waste material and the volume of oxidizer into the plasma zone of the non-thermal plasma generator.

13. The method of claim 1, further comprising directing an incineration product, resulting from incineration of the medical waste material, from the plasma zone to a homogenization zone, the homogenization zone comprising a homogenization material to at least partially homogenize the incineration product, wherein the incineration product comprises a material other than a solid material.

14. The method of claim 1, further comprising directing an incineration product, resulting from incineration of the medical waste material, from the plasma zone to a heat transfer zone to release heat from the incineration product prior to outputting the incineration product from the non-thermal plasma generator.

* * * * *